US007928350B2

(12) United States Patent
Yoshino et al.

(10) Patent No.: US 7,928,350 B2
(45) Date of Patent: Apr. 19, 2011

(54) MICROWAVE HEATING DEVICE

(75) Inventors: Koji Yoshino, Yamatokoriyama (JP); Susumu Idomoto, Yamatokoriyama (JP); Tomotaka Nobue, Yamatokoriyama (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 10/539,109

(22) PCT Filed: Feb. 5, 2004

(86) PCT No.: PCT/JP2004/001205

§ 371 (c)(1),
(2), (4) Date: Jun. 15, 2005

(87) PCT Pub. No.: WO2004/071133

PCT Pub. Date: Aug. 19, 2004

(65) Prior Publication Data

US 2006/0081626 A1 Apr. 20, 2006

(30) Foreign Application Priority Data

Feb. 5, 2003 (JP) ..... 2003-028450

(51) Int. Cl.
*H05B 6/72* (2006.01)

(52) U.S. Cl. ..... 219/756; 219/757; 219/749; 126/21 A

(58) Field of Classification Search ..... 219/756, 219/750, 710, 748, 749, 754, 746, 751, 681; 43/45; 250/492.21

See application file for complete search history.

(56) References Cited

U.S. PATENT DOCUMENTS

| | | | | |
|---|---|---|---|---|
| 3,210,511 | A * | 10/1965 | Smith | 219/748 |
| 3,716,687 | A * | 2/1973 | Constable | 219/681 |
| 4,307,285 | A * | 12/1981 | DeRemer | 219/392 |
| 4,463,239 | A * | 7/1984 | Miller | 219/749 |
| 4,556,772 | A * | 12/1985 | McCammon et al. | 219/757 |
| 4,714,811 | A * | 12/1987 | Gerling et al. | 219/751 |
| 5,880,442 | A * | 3/1999 | You | 219/746 |
| 6,759,665 | B2 * | 7/2004 | Benveniste et al. | 250/492.21 |
| 2004/0216732 | A1 * | 11/2004 | McFadden | 126/21 A |

FOREIGN PATENT DOCUMENTS

| | | |
|---|---|---|
| DE | 2841176 | 4/1979 |
| DE | 4433105 | 9/1994 |

(Continued)

OTHER PUBLICATIONS

Japanese Office Action for 2003-028450.

*Primary Examiner* — Quang T Van
(74) *Attorney, Agent, or Firm* — Pearne & Gordon LLP

(57) ABSTRACT

In a microwave heating apparatus, an electricity feeding port constituting a port of radiating a microwave is set to a ceiling wall of a heating chamber, a magnetron is arranged on a side of an outer side face of the heating chamber by directing an antenna for oscillating the microwave to a side of the heating chamber, and a wave guide for guiding the microwave oscillated from the magnetron to the electricity feeding port is formed in an L-like shape including a side wave guide extended upwardly from a surrounding of the antenna along the outer side face of the heating chamber and an upper wave guide extended from an upper end of the side wave guide to the electricity feeding port along an outer face of the ceiling wall.

11 Claims, 7 Drawing Sheets

FOREIGN PATENT DOCUMENTS

| | | | |
|---|---|---|---|
| EP | 0373608 | | 6/1990 |
| JP | 53-1346 | A | 1/1978 |
| JP | 54-48348 | | 4/1979 |
| JP | 56-114096 | | 9/1981 |
| JP | 57-103292 | | 6/1982 |
| JP | 59-194389 | | 11/1984 |
| JP | 62-100982 | | 5/1987 |
| JP | 63-174396 | | 7/1988 |
| JP | 5-74568 | | 3/1993 |
| JP | 05234670 | | 9/1993 |
| NL | 6713127 | | 4/1968 |
| WO | 9835533 | | 8/1998 |

* cited by examiner

MICROWAVE HEATING DEVICE

TECHNICAL FIELD

The present invention relates to a microwave heating apparatus for heating a heating object such as food or the like by a microwave (high frequency electromagnetic wave), particularly relates to an improvement in realizing small-sized formation of the apparatus by enabling to arrange a waveguide having a length in an axial direction equal to or larger than a wavelength of a microwave in the waveguide at an upper portion of a heating chamber to thereby save a space thereof while restraining a deviation in an electric field intensity distribution bringing about an unevenness in heating.

BACKGROUND ART

A microwave heating apparatus of this kind is generally constituted to include a heating chamber containing an object to be heated, a magnetron for oscillating a microwave, an electricity feeding port formed at a wall face of the heating chamber from which the microwave is radiated into the heating chamber, a waveguide for guiding the microwave to the electricity feeding port. A position of arranging the electricity feeding port and a mode of the electricity feeding port are devised in order to prevent an unevenness in heating from being brought about by reducing a deviation in an electric field intensity distribution at inside of the heating chamber.

As a position of arranging the electricity feeding port, any of inner wall faces partitioning the heating chamber is selectable and heretofore, there have been proposed various constitutions of a constitution of providing the electricity feeding port at a side wall of the heating chamber, a constitution of providing the electricity feeding port at a bottom wall of the heating chamber, a constitution of providing the electricity feeding port at a ceiling wall of the heating chamber and so on.

Further, generally, it is difficult to resolve the deviation in the electric field intensity distribution at inside of the heating chamber by simply providing the electricity feeding port and in order to resolve occurrence of the unevenness in heating caused by the deviation in the electric intensity distribution, it is dispensable to mount rotating means (stirrer) for stirring the microwave or a turntable for turning the object at inside of the heating chamber and by mounting these, the apparatus tends to be large-sized.

In a market of the microwave heating apparatus in recent times, small-sized formation is required. Hence, there has been intensively carried out a research of achieving small-sized formation by omitting to mount the stirrer or the turntable by arranging the electricity feeding port at the ceiling wall of the heating chamber.

FIG. 7 shows a microwave heating apparatus of a background art arranged with an electricity feeding port constituting a port of radiating a microwave at a ceiling wall of heating chamber (refer to, for example, JP-A-57-103292).

FIG. 7 is a sectional view viewing a microwave heating apparatus 1 disclosed in JP-A-57-103292 as mentioned above, from a front side, and the microwave heating apparatus 1 is constituted to include an external cabinet 3, a heating chamber 5 for containing an object such as food or the like to be heated, a magnetron 7 for oscillating a microwave, an electricity feeding port 9 formed at a ceiling wall 11 of the heating chamber 5 from which a microwave is radiated into the heating chamber 5, and a waveguide 13 for guiding the microwave oscillated from an antenna 12 of the magnetron 7 to the electricity feeding port 9.

The magnetron 7 is arranged on a right outer side of the heating chamber 5 and attached to a base end of the waveguide 13 in an attitude of directing the antenna 12 upwardly.

The illustrated waveguide 13 is constituted by a shape of a straight pipe having a rectangular section and is provided with a length from a surrounding of the antenna 12 to the electricity feeding port 9.

Meanwhile, when a wave length of the microwave propagated at inside of the wave guide 13 is designated by notation $\lambda g$, in order to efficiently radiating the microwave from the electricity feeding port 9, with regard to a length in an axial direction of the wave guide 13, it is preferable to constitute a distance between the antenna 12 of the magnetron 7 and a center of the electricity feeding port 9 by $\lambda g/2$ multiplied by an integer. Further, in order to restrain a deviation in an electric field intensity distribution bringing about a nonuniformity in heating, it is preferable to make the electricity feeding port as proximate to a center of the heating chamber as possible.

However, according to the wave guide 13 in the shape of the straight pipe as shown by FIG. 7, in the case in which a width dimension of the heating chamber 5 is designated by notation $W_1$, and a distance from a right side wall 15 of the heating chamber 5 to the center of the electricity feeding port 9 is designated by notation $L_1$, when with regard to the length in the axial direction of the wave guide 13, the distance between the antenna 12 and the center of the electricity feeding port 9 is constituted by $3/2\ \lambda g$, a clearance is produced between the magnetron 7 and the right side wall 15.

The clearance becomes a wasteful space and therefore, although various methods have been adopted in order to prevent the wasteful space, first, when the magnetron 7 is shifted to a left side of the drawing, the distance between the antenna 12 and the center of the electricity feeding port 9 is shifted from $\lambda g/2$ multiplied by an integer.

Second, when the magnetron 7 and the wave guide 13 and the electricity feeding port 9 are simultaneously shifted to the left side of the drawing, the electricity feeding port 9 is shifted from the center of the heating chamber 5.

Third, when the right side wall 15 of the heating chamber 5 is shifted to a right side of the drawing, the electricity feeding port 9 is similarly shifted from the center of the heating chamber 5.

Fourth, although it is conceivable to shift a left side wall of the heating chamber 5 to the left side simultaneous with the third method, in such a method, the width dimension $W_1$ of the heating chamber 5 is increased.

Further, a height of the wave guide 13 needs to be equal to or larger than a length of the antenna 12 and there also poses a problem that an increase in a height dimension $H_1$ of the wave guide 13 gives rise to an increase in the dimension in a height direction of the apparatus.

The invention has been carried out in view of the above-described problem and it is an object thereof to provide a microwave heating apparatus capable of restraining a deviation in an electric field intensity distribution causing to bring about a nonuniformity in heating by eliminating a wasteful space between a magnetron and an outer side face of a heating chamber and setting an electricity feeding port at a center in a width direction of the heating chamber even when a distance between an antenna and a center of the electricity feeding port is set to a half of a wave length of a microwave at inside of a wave guide multiplied by an integer with regard to a length in an axial direction of the wave guide, capable of shortening a height dimension of the apparatus by contracting a height dimension of the wave guide along a direction of projecting an antenna of the magnetron and capable of realizing small-sized formation of the apparatus while restraining the non-uniformity in heating caused by a deviation in a position of mounting the electricity feeding port from being brought about.

DISCLOSURE OF INVENTION

In order to achieve the above-described object, a microwave heating apparatus according to the invention is characterized in a microwave heating apparatus for radiating a microwave oscillated from a magnetron to a heating chamber via a wave guide, wherein an electricity feeding port constituting a port of radiating the microwave is provided at a ceiling wall of the heating chamber, and the wave guide is formed in an L-like shape including a side wave guide extended upwardly along an outer side face of the heating chamber and an upper wave guide extended from an upper end of the side wave guide to the electricity feeding port along an outer face of the ceiling wall.

According to such a constitution, a distance between the antenna of the magnetron and a center of the electricity feeding port can easily be changed by only changing a position of the magnetron and a length of the side wave guide in an up and down direction and therefore, even when a width dimension of the heating chamber is any dimension, the distance can be selected to be a half of a wave length in the wave guide multiplied by an integer without including a wasteful space.

Further, in order to achieve the above-described object, the microwave heating apparatus is characterized in that an antenna of the magnetron is arranged to be directed to a side of the heating chamber and to be opposed to the side wall and the side wall is formed with a bulged portion bulged to an inner side of the chamber for avoiding interference with the antenna in the microwave heating apparatus.

According to the microwave heating apparatus constituted in this way, a height dimension of the wave guide at the surrounding of the antenna of the magnetron is substantially constituted by adding a height dimension $h_3$ of the bulged portion of the side wall of the heating chamber to an actual height dimension $h_2$ of the wave guide, the actual height dimension $h_2$ per se of the wave guide can be shortened to a value smaller than a value of a length of projecting the antenna of the magnetron, thereby, a height dimension of the apparatus can be shortened by contracting a dimension of the wave guide along the direction of projecting the antenna of the magnetron.

Further, small-sized formation of the heating chamber by the wave guide in the L-like shape and shortening of the height dimension of the wave guide by mounting the bulged portion to the side wall of the heating chamber are synergetically combined and small-sized formation of the apparatus promoting space efficiency can be realized while preventing occurrence of a nonuniformity in heating caused by a deviation of a position of mounting the electricity feeding port.

Further, preferably, in the microwave heating apparatus, there may be constructed a constitution in which the electricity feeding port is formed in a rectangular shape slender in a width direction of the heating chamber.

When constituted in this way, even by the electricity feeding port arranged at a position deviated from the center of the heating chamber, occurrence of the nonuniformity in heating can be restrained by reducing a deviation of an electric field intensity distribution at the heating chamber.

Further, preferably, in the microwave heating apparatus, there may be constructed a constitution in which a plurality of pieces of the electricity feeding ports are provided.

Further, in that case, there may be constructed a constitution in which the plurality of electricity feeding ports are formed by at least two or more kinds of electricity feeding ports having different shapes and opening areas.

Further, there may be constructed a constitution in which when the plurality of electricity feeding ports are aligned in a front and rear direction of the ceiling wall, the opening area of the electricity feeding port at a position proximate to a center of the ceiling wall is set to be larger than the opening area of the electricity feeding port at a position remote from the center of the ceiling wall.

In this way, formation of the plurality of pieces of electricity feeding ports and various formations of shapes and areas of the electricity feeding ports are effective when the deviation of the electric field intensity distribution as a total of the heating chamber is alleviated by adjusting rates of radiating the microwaves from the respective electricity feeding ports when the position of mounting the electricity feeding port is deviated from the center of the ceiling wall of the heating chamber.

Further, in the microwave heating apparatus, the microwave heating apparatus is characterized in that a heating member in a linear shape for heating by a heater is mounted to the ceiling wall of the heating chamber and the electricity feeding port is mounted to a position at which a line equally dividing the ceiling wall into two in a front and rear direction is not included.

Further preferably, in the microwave heating apparatus, there may be constructed a constitution in which a heating member in a linear shape for heating by a heater is mounted to the ceiling wall of the heating chamber and a center axis of the heating member is constituted to be more proximate to a line equally dividing the ceiling wall into two in a front and rear direction than a center axis line in a width direction of the upper wave guide arranged at the ceiling wall.

When constituted in this way, adjustment for reducing a deviation in a temperature distribution of an atmosphere by radiating heat of the heating member can be carried out in correspondence with adjustment of the deviation of the electric field intensity distribution by the microwave and occurrence of a nonuniformity in heating by the microwave and the radiation heat can be reduced.

Further, in the microwave heating apparatus, there may be constructed a constitution in which the heating member is arranged to be inclined to the line equally dividing the ceiling wall into two in the front and rear direction.

When constituted in this way, in comparison with a case of arranging the heating member in parallel with the line equally dividing the ceiling wall of the heating chamber into two in the front and rear direction, a heating region of the heating chamber by the heating member is widened in the front and rear direction of the heating chamber and the nonuniformity in heating by heating by a heater can further be restrained.

Further, in the microwave heating apparatus, there may be constructed a constitution in which stirring means for stirring the microwave is mounted to a wall face of the heating chamber when space is permitted.

In this way, mounting of the stirring means is effective in further restraining occurrence of the nonuniformity in heating by preventing the deviation of the microwave in the heating chamber by stirring the microwave.

Figure 1:
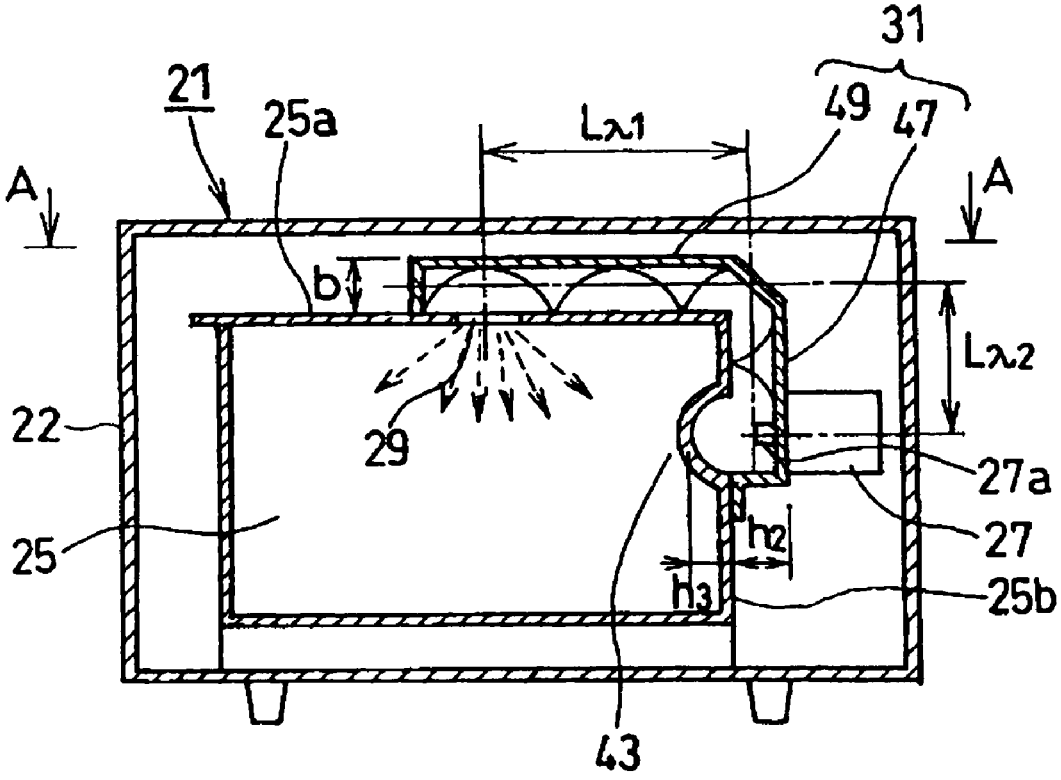
FIG. 1 is a sectional view of an inner portion or a first embodiment of a microwave heating apparatus according to the invention in view from a front side thereof.

Further, in notations of the drawings, numeral 21 designates a microwave heating apparatus, numeral 23 designates an object to be heated, numeral 25 designates a heating chamber, notation 25*a* designates a ceiling wall, notation 25*b* designates a right side wall, numeral 27 designates a magnetron, notation 27*a* designates an antenna, numeral 29 designates an electricity feeding port, notation 29*a* designates an electricity feeding port, notation 29*b* designates an electricity feeding port, numeral 31 designates a wave guide, numeral 33 designates a heating member, numeral 35 designates a grill, numeral 37 designates an opening/closing door, numeral 41 designates a recessed portion, numeral 43 designates a bulged portion, numeral 47 designates a side wave guide, numeral 49 designates an upper wave guide, and numeral 51 designates a microwave heating apparatus.

BEST MODE FOR CARRYING OUT THE INVENTION

A detailed explanation will be given of a microwave heating apparatus according to a first embodiment of the invention in reference to the attached drawings as follows.

Figure 2:
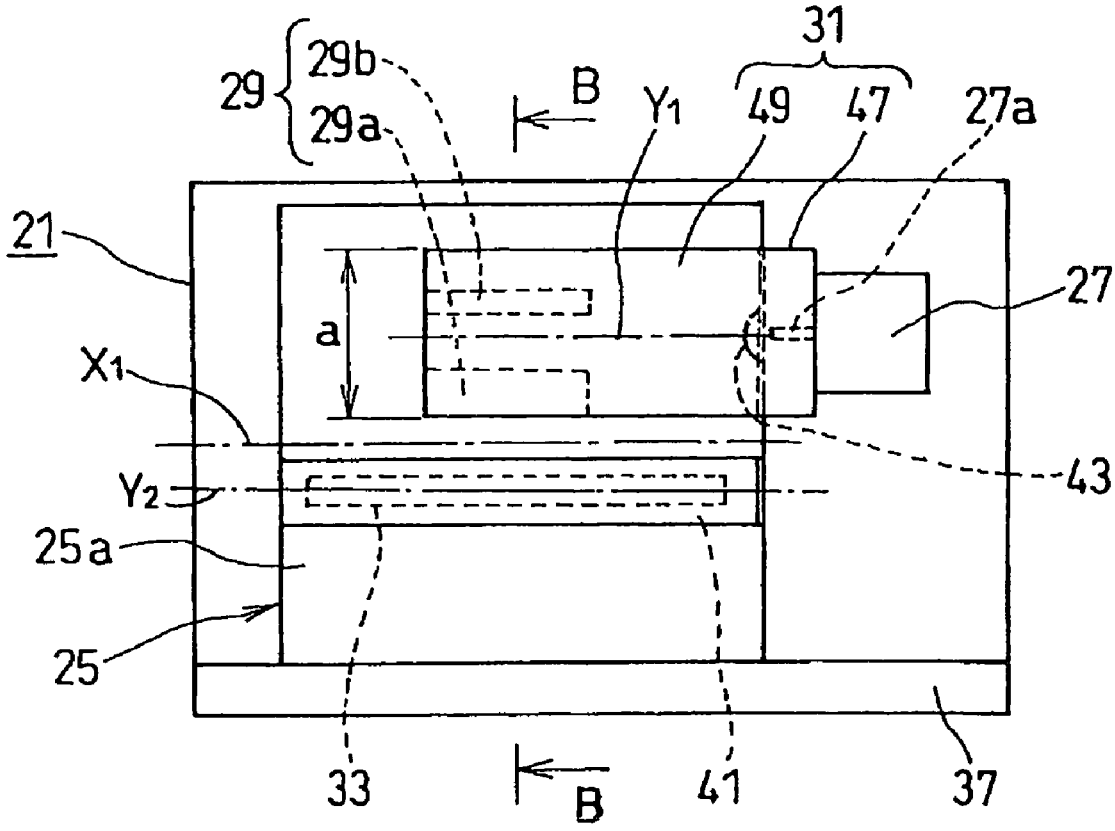
FIG. 2 is a view viewing FIG. 1 from an arrow mark of a line A-A.
Figure 3:
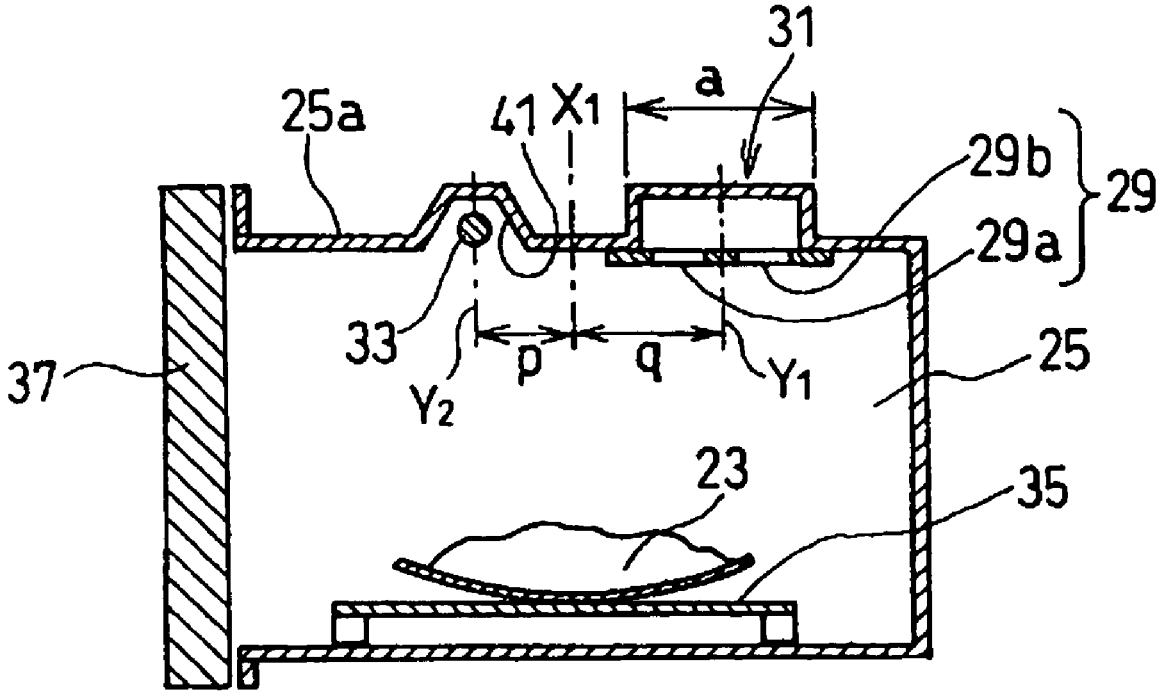
FIG. 3 is a sectional view taken along a line B-B of FIG. 2.

FIG. 1 through FIG. 3 show the first embodiment of the microwave heating apparatus according to the invention, FIG. 1 is a sectional view of an inner portion viewed from the front side, FIG. 2 is a view viewing FIG. 1 along an arrow mark of a line A-A, and FIG. 3 is a sectional view taken along a line B-B of FIG. 2.

The microwave heating apparatus 21 according to the first embodiment is provided with the heating chamber 25 for containing the object 23 of food or the like, the magnetron 27 for oscillating a microwave, the electricity feeding port 29 formed at a wall face of the heating chamber 25 and constituting a port of radiating the microwave into the heating chamber 25, the wave guide 31 for guiding the microwave oscillated from the magnetron 27 to the electricity feeding port 29, the heating member 33 in a linear shape for heating by a heater, and a grill 35 mounted to a bottom portion of the heating chamber 25 for assisting heating operation.

Further, the above-described respective constituent elements including the heating chamber 25 are contained at inside of an external cabinet 22.

The heating chamber 25 is formed in a shape of a box a front side of which is made to be openable and closable by the opening/closing door 37, as shown by FIG. 2 and FIG. 3, the heating member 33 is mounted to an upper portion of the heating chamber 25 frontward from a line $X_1$ equally dividing the ceiling wall 25*a* into two in a front and rear direction, further, the electricity feeding port 29 is mounted at a position rearward from the line $X_1$ equally dividing the ceiling wall 25*a* into two in the front and rear direction.

A position of the ceiling wall 25*a* in correspondence with the heating member 33 is formed with the recessed portion 41 for containing the heating member 33 and a consideration is given thereto such that the heating member 3 is not projected into the heating chamber.

In the case of the embodiment, the electricity feeding port 29 is constituted by two of electricity feeding ports 29*a*, 29*b* positions of which are shifted from each other in the front and rear direction. Either of shapes of the two electricity feeding ports 29*a*, 29*b* is a rectangular shape slender in a width direction of the heating chamber 25 (that is, in an axial direction of the wave guide 31, mentioned later). Further, the two electricity feeding ports 29*a*, 29*b* are provided at a region which does not include a pipe axis $Y_1$ of the wave guide 31 (in correspondence with an axial line constituting a center of a width dimension a of the wave guide 31, mentioned later). Further, as shown by FIG. 2 and FIG. 3, an opening area of the electricity feeding port 29*a* at a position proximate to a center of the ceiling wall 25*a* is set to be larger than an opening area of the electricity feeding port 29*b* at a position remote from the center of the ceiling wall 25*a*.

The opening areas of the electricity feeding ports 29*a*, 29*b* are made to differ from each other in this way for making a deviation of an electric field intensity distribution as small as possible for an entire region of inside of the heating chamber 25 by adjusting radiation efficiencies, radiation angles and the like of microwaves from the respective openings.

As shown by FIG. 1 and FIG. 2, the magnetron 27 is arranged on a side of a right outer side face of the heating chamber 25 to direct the antenna 27*a* oscillating the microwave to a side of the heating chamber 25.

Further, the right side wall 25*b* of the heating chamber 25 opposed to the antenna 27*a* is formed with the bulged portion 43 for avoiding interference with the antenna 27*a* in a mode of being bulged to an inner side of the chamber.

The wave guide 31 is formed in an L-like shape including the side guide wave 47 extended upwardly from a surrounding of the antenna 27*a* along the right outer side face of the heating chamber 25 and the upper wave guide 49 extended from an upper end of the side wave guide 47 to the electricity feeding port 29 along an outer face of the ceiling wall 25*a*.

The side wave guide 47 partitions a wave guide path in a shape of a rectangular shape pipe for guiding the microwave in cooperation with the right side wall 25*b* of the heating chamber 25. Further, the upper wave guide 49 partitions a wave guide path in a shape of a rectangular pipe for guiding the microwave in cooperation with the ceiling wall 25*a* of the heating chamber 25.

In the case of the side guide wave 47, a height dimension $h_2$ constituting a direction of projecting the antenna 27*a* is set to be smaller than a length of projecting the antenna 27*a* since interference with the antenna 27*a* can be avoided by presence of a height dimension $h_3$ of the bulged portion 43. A height dimension b of the upper wave guide 49 is set to be the same as the height dimension $h_2$ of the side wave guide 47 (that is, $b=h_2$).

Further, a position of attaching the wave guide 31 to the heating chamber 25 is set such that the electricity feeding port 29*a* is disposed on a front side of the apparatus and the electricity feeding port 29*b* is disposed on a rear side of the apparatus interposing the axis line $Y_1$ constituting the center of the width dimension a.

Such an attaching position effects influence on an electric field intensity distribution at inside of the heating chamber 25 and a temperature distribution of a heating atmosphere owing to a relationship with a wave length of the microwave radiated into the heating chamber 25.

As shown by FIG. 3, when a separated distance to a center axis $Y_2$ of the heating member 33 from the line $X_1$ equally dividing the ceiling wall 25*a* into two in the front and rear direction is designated by notation p, and a separated distance to the center axis line $Y_1$ of the wave guide 31 therefrom is designated by notation q, it is preferable to set a relationship of p<q and nullify p as much as possible.

Because although in the case of the microwave radiated from the electricity feeding port 29 into the chamber 25, a radiation density at inside of the heating chamber 25 can be adjusted by various means of an opening area or an opening position of the electricity feeding port 29 provided by the invention, or reflection by the grill 35 or the like and the deviation of the electric field intensity distribution can easily be adjusted, with regard to a temperature distribution of an atmosphere by radiation by the heating member 33, in order to reduce a deviation thereof, it is best to install the heating member 33 per se as proximate to the center of the heating chamber 25 as possible.

According to the above-described constitution, as shown by FIG. 1, with regard to the length in the axial direction of the wave guide 31, even when the distance between the antenna 27*a* of the magnetron 27 and the center of the electricity feeding port 29 is set to, for example, 3/2 λg which is equal to a half of a wave length λg of the microwave in the wave guide multiplied by an integer by which the microwave can efficiently be radiated from the electricity feeding port 29, the distance can easily be ensured by regarding the length in the axial direction of the wave guide 31 as a sum of length dimensions $L\lambda 1 + L\lambda_2$ of the upper wave guide 49 and the side wave guide 47 and adjusting the position of the magnetron 27 and the length of the wave guide 47. As a result, even when the width dimension of the heating chamber 25 is constituted by any dimension, the electricity feeding port 29 can be set to the center of the heating chamber 25 and small-sized formation of the apparatus can be achieved by dispensing with formation of a wasteful space between the magnetron 27 and the side wall 25*b* of the heating chamber 25 while preventing a nonuniformity in heating by a deviation of an electric field intensity distribution from being brought about.

Further, according to the microwave heating apparatus 21 of the embodiment, a height dimension of the wave guide 31 at a surrounding of the antenna 27*a* of the magnetron 27 is substantially constituted by adding the height dimension $h_3$ of the bulged portion 43 of the side wall 25*b* of the heating chamber 25 to the actual height dimension $h_2$ of the wave guide 31, the actual height dimension $h_2$ per se of the wave guide 31 can be shortened to a value smaller than the length of projecting the antenna 27*a* of the magnetron 27, thereby, the height dimension of the apparatus can be shorted by contracting the dimension of the wave guide 31 along the direction of projecting the antenna 27*a* of the magnetron 27.

Further, small-sized formation of the heating chamber 25 by the wave guide 31 in the L-like shape and shortening of the height dimension of the wave guide 31 by mounting the bulged portion 43 to the side wall 25*b* of the heating chamber 25 are synergetically combined and small-sized formation of the apparatus promoting space efficiency can be realized while preventing a nonuniformity in heating caused by the deviation of a position of mounting the electricity feeding port 29 from being brought about.

Further, the microwave heating apparatus 21 of the embodiment is mounted with the heating member 33 and can be used also as an oven range (oven toaster) and therefore, the apparatus can be utilized for wider cooking use.

Further, although the ceiling wall 25*a* of the heating chamber 25 is provided with both of the heating member 33 for heating by a heater and the electricity feeding port 29 for heating by a microwave, the heating member 33 is made to be more proximate to the line $X_1$ equally dividing the ceiling wall 25*a* into two in the front and rear direction and the electricity feeding port 29 and therefore, the deviation of the temperature distribution of the atmosphere in the heating chamber 25 is small and a drawback of the nonuniformity in heating or the like is difficult to be brought about.

Meanwhile, the electricity feeding port 29 is disposed at the center of the width direction of the heating chamber 25 and is arranged to be deviated rearward from the center of the heating chamber 25 only in the front and rear direction of the heating chamber 25. Hence, with regard to such an eccentricity in the front and rear direction, the electricity feeding port 29*a* having a large aperture and the electricity feeding port 29*b* having a small aperture are combined to thereby make radiation of the microwave into the heating chamber 25 as uniform as possible, as a result, even in the case of the microwave heating, the deviation in the electric field intensity distribution at inside of the heating chamber 25 is restrained to thereby restrain occurrence of the nonuniformity in heating, even when mounting of a turn table or the like which gives rise to large-sized formation of the apparatus is omitted, uniform heating to the object can be realized and small-sized formation of the apparatus can be realized without sacrificing the heating characteristic.

Figure 4:
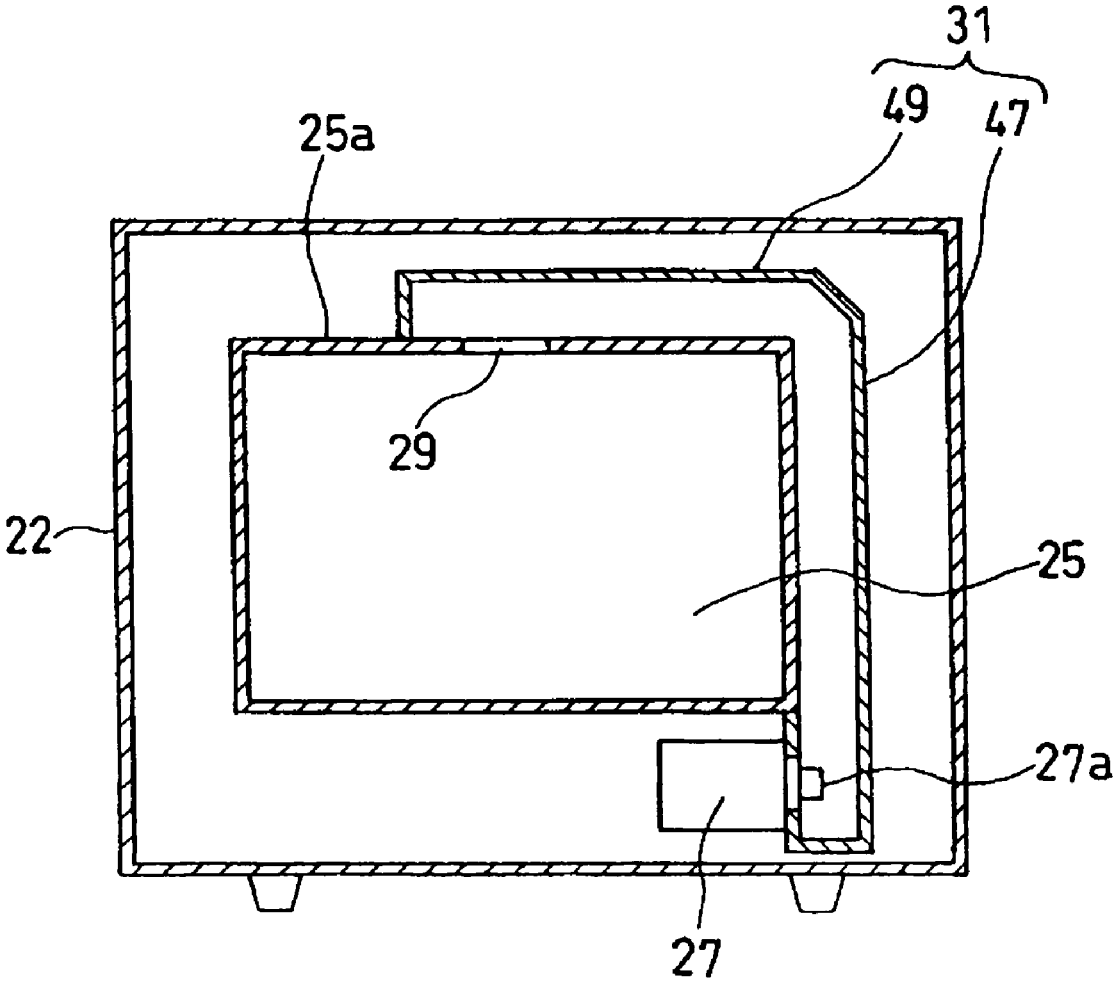
FIG. 4 is a sectional view of an inner portion of a modified example of the first embodiment of the microwave heating apparatus according to the invention viewed from the front side.

FIG. 4 shows a modified example of the microwave heating apparatus according to the first embodiment of the invention.

According to the modified example, the wave guide 31 formed in the L-like shape by including the side wave guide 47 and the upper wave guide 49 is constituted such that the side wave guide 47 is formed to extend to a lower side of the heating chamber 25 and the magnetron 27 is arranged at a position below the heating chamber 25. Further, the other constitution is the same as that of the first embodiment.

By arranging the magnetron 27 at the position below the heating chamber 25 in this way, small-sized formation can further be achieved by shortening the width dimension of the apparatus.

Figure 5:
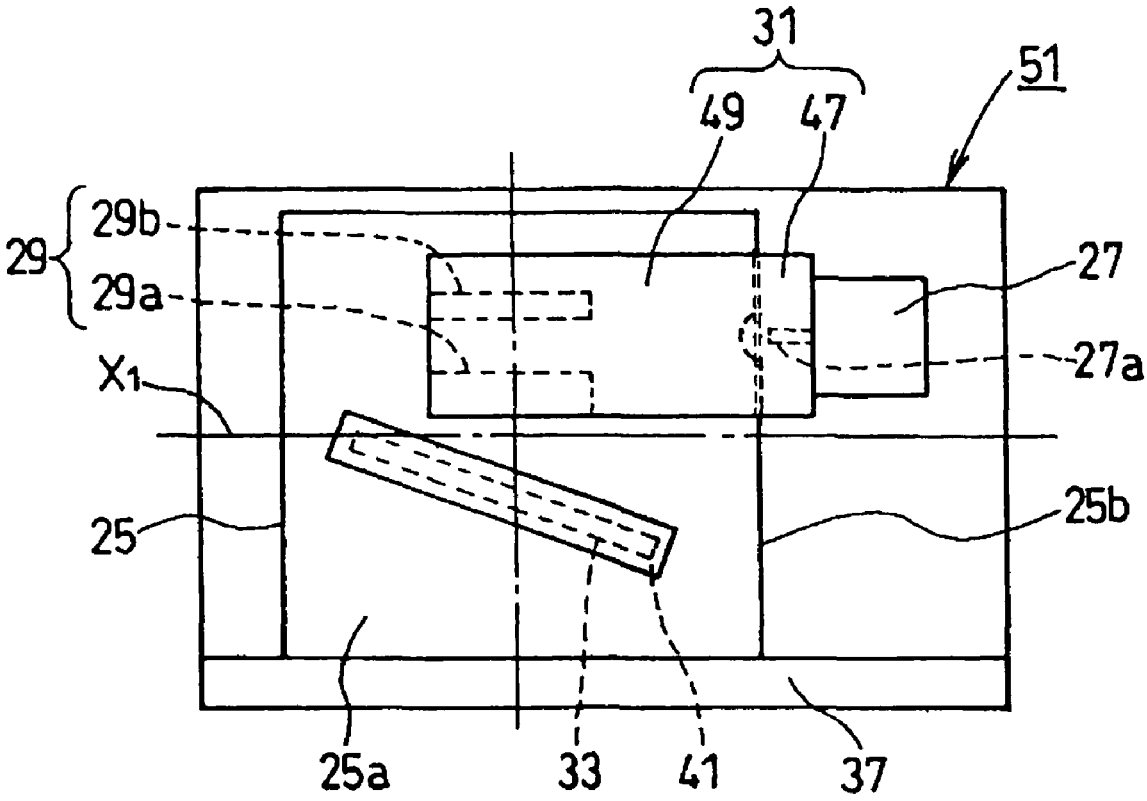
FIG. 5 shows an outline constitution of an inner portion of a second embodiment of a microwave heating apparatus according to the invention viewed from an upper side.

FIG. 5 shows an outline constitution of an inner portion of a second embodiment of a microwave heating apparatus according to the invention viewed from an upper side.

According to a microwave heating apparatus 51 of the second embodiment, the heating member 33 for heating by a heater is arranged to be inclined to the line $X_1$ equally dividing the ceiling wall 25*a* into two in the front and rear direction and the other constitution is common to the case of the first embodiment. Constitutions common to those of the first embodiment are attached to the same notations and an explanation thereof will be omitted.

When constituted in this way, in comparison with the case of the first embodiment in which the heating member 33 is arranged in parallel with the line X1 equally dividing the ceiling wall 25*a* into two in the front and rear direction, a heating region of the heating chamber 25 is widened in the front and rear direction and a nonuniformity in heating by an oven can further be restrained.

Further, in the microwave heating apparatus according to the invention, it is preferable to set a width dimension a and a height dimension b of the wave guide having a rectangular section shown in FIG. 6(*a*) to satisfy Equation (1) and Equation (2) as follows when the wave length of the microwave in a free space is designated by notation $\lambda_0$.

$$(\lambda_0/2) < a < \lambda_0 \quad (1)$$

$$b < (\lambda_0/2) \quad (2)$$

Further, although according to the above-described respective embodiments, two pieces of the main and sub electricity feeding ports are arranged to align in the front and rear direction, a number of mounting the electricity feeding ports is not limited to that of the above-described embodiments. The number of mounting the electricity feeding port can also be made to be single and can also be set to a plurality of pieces of 3 pieces or more.

Further, design of the electricity feeding port such as mounting position, shape, opening area or the like can pertinently be changed in accordance with a degree of being proximate to the line $X_1$ equally dividing the ceiling wall 25*a* of the heating chamber 25 into two in the front and rear direction.

In sum, the electricity feeding port may be made to be able to adjust such that the deviation of the electric field intensity distribution causing the nonuiformity in heating is eliminated as much as possible.

Figure 6:
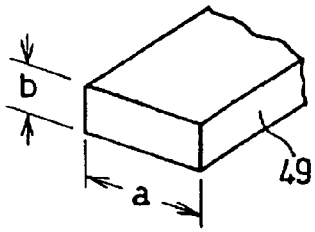
FIG. 6 illustrates explanatory views of other embodiment of an electricity feeding port arranged at a front end of an upper wave guide according to the invention.
Figure 6:
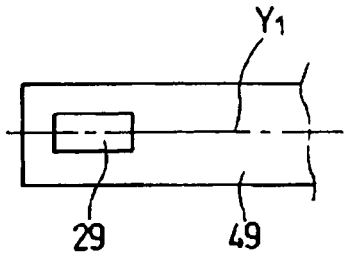
Figure 6:
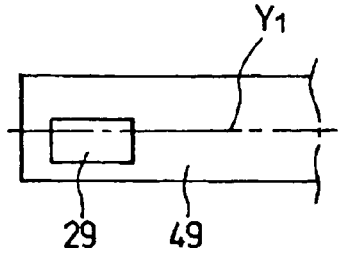
Figure 6:
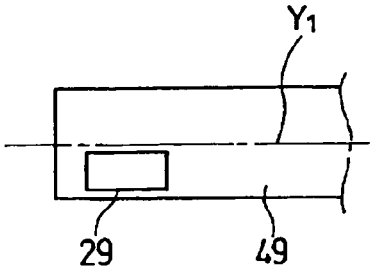
Figure 6:
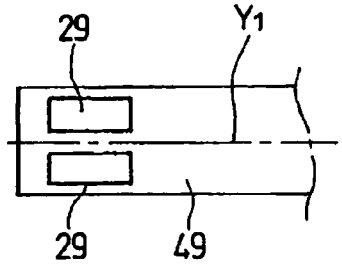
Figure 6:
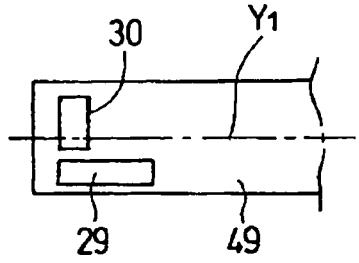
Figure 7:
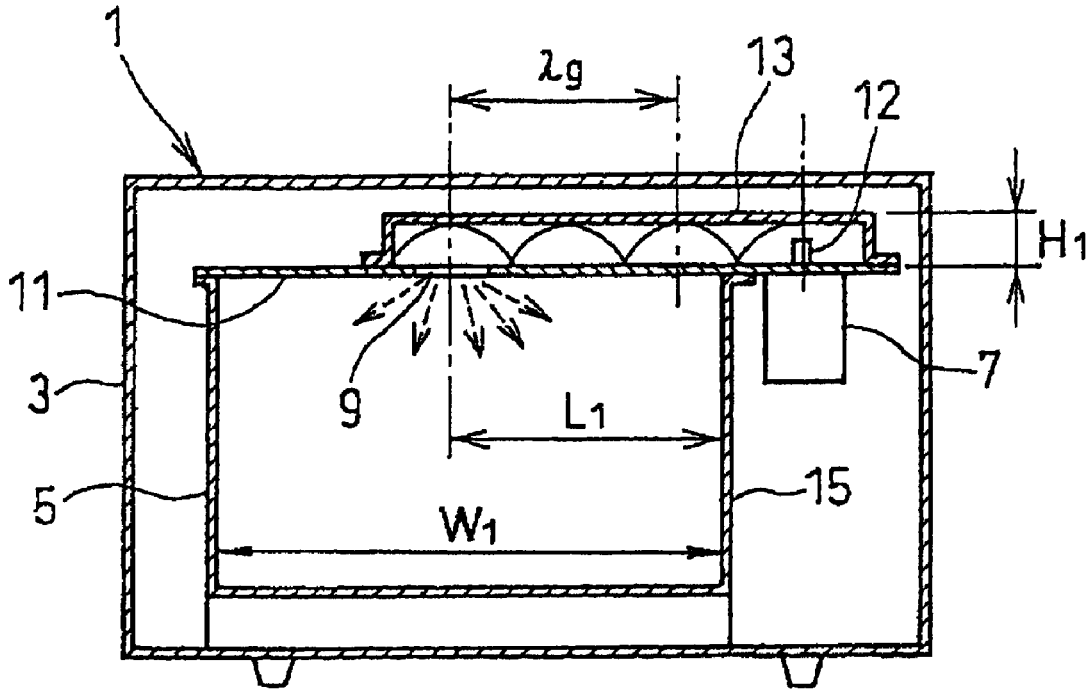
FIG. 7 is a sectional view viewing a microwave heating apparatus of a background art from a front side.

FIGS. 6(*b*) through 6(*f*) show modified examples of the mounting position and the mounting number of the electricity feeding port 29 at the front end of the upper wave guide 49. In this way, the electricity feeding port can be designed variously.

FIG. 6(*b*) shows an example of mounting the single electricity feeding port 29 slender in the axial direction by aligning the center to the center axis line $Y_1$ in the width direction of the upper wave guide 49.

FIG. 6(*c*) shows an example of mounting the single electricity feeding port 29 slender in the axial direction by being shifted to the front side from the center axis line $Y_1$ in the width direction of the upper wave guide 49.

FIG. 6(*d*) shows an example of mounting the single electricity feeding port 29 slender in the axial direction by being shifted considerably to the front side not to be caught by the center axis line $Y_1$ in the width direction of the upper wave guide 49.

FIG. 6(*e*) shows an example of mounting the two electricity feeding ports 29, 29 slender in the axial direction respectively to the front side and the rear side interposing the center axis line $Y_1$ in the width direction of the upper wave guide 49.

FIG. 6(*f*) shows an example of mounting the electricity feeding port slender in the axial line direction frontward from the axis line $Y_1$ not to be caught by the center axis line $Y_1$ in the width direction of the upper wave guide 49 and mounting an electricity feeding port 30 slender in a direction orthogonal to the axis line $Y_1$ to be partially caught by the axis line $Y_1$.

There is also conceivable a structure of mounting a number of electricity feeding ports in a shape of a matrix in an axial direction although not illustrated. Further, there is also conceivable that a plurality of mounted electricity feeding ports are formed by electricity feeding ports of at least two or more kinds having different shapes and opening areas. For example, an electricity feeding port may be constituted by a circle, an ellipse, a triangle or other polygonal shape or may be formed only by a curve or a curve and a straight line.

The above-described formation of a plurality of pieces of the electricity feeding ports, various formations of shapes and areas of the electricity feeding ports or the like are effective in alleviating the deviation of the electric field intensity distribution as a total of the heating chamber 25 by adjusting a rate of radiating the microwave from each electricity feeding port 29 when the mounting position of the electricity feeding port 29 is deviated from the center of the ceiling wall 25*a* of the heating chamber 25.

Further, although in FIG. 6, there is a clearance between the electricity feeding port and a left end portion of the wave guide, there may be constructed a constitution of dispensing with the clearance.

Further, stirring means for stirring the microwave may be mounted to the inner wall face of the heating chamber when there is allowance in dimensions and the like although the stirring means is not mounted in the above-described embodiments since small-sized formation is made to be mostly predominant.

Mounting of the stirring means is effective in restraining occurrence of the nonuniformity in heating by preventing the deviation of the microwave by stirring the microwave.

Although an explanation has been given of the invention in details and in reference to the specific embodiments, it is apparent for the skilled person that the present invention can variously be changed and modified without deviating from the sprit and the range of the invention.

The application is based on Japanese Patent Application No. 2003-028450 filed on Feb. 5, 2003 and a content thereof is incorporated here by reference.

INDUSTRIAL APPLICABILITY

According to the microwave heating apparatus of the invention, by setting the length in the axial direction of the wave guide as the sum of the length dimensions on the upper wave guide and the side wave guide, even when the width dimension of the heating chamber is any dimension, the electricity feeding port can arbitrary be set and occurrence of the nonuniformity in heating by the deviation of the electric field intensity distribution can be prevented. Further, small-sized formation of the apparatus can be achieved by eliminating formation of a wasteful space between the magnetron and the side wall of the heating chamber.

Further, when the invention is constructed by a constitution described in claim 2, the height dimension of the wave guide at the surrounding the antenna of the magnetron is substantially constituted by adding the height dimension $h_3$ of the bulged portion of the side wall of the heating chamber to the actual height dimension $h_2$ of the wave guide, the actual height dimension $h_2$ of the wave guide per se can be shortened to the value smaller than the length of projecting the antenna of the magnetron, thereby, the height dimension of the apparatus can be shortened by contracting the dimension of the wave guide along the direction of projecting the antenna of the magnetron.

Further, small-sized formation of the heating chamber by the wave guide in the L-like shape and shortening of the height dimension of the wave guide by mounting the bulged portion to the side wall of the heating chamber are synergetically combined and small-sized formation of the apparatus promoting space efficiency can be realized while preventing occurrence of the nonuniformity in heating caused by the deviation of the position of mounting the electricity feeding port.

The invention claimed is:

1. A microwave heating apparatus for radiating a microwave oscillated from a magnetron to a heating chamber via a waveguide, wherein a plurality of electricity feeding ports for radiating the microwave are provided at a ceiling wall of the heating chamber, and the wave guide is formed in an L-like shape including a side waveguide extended upwardly along an outer side face of the heating chamber such that the side waveguide is in direct contact with the outer side face of the heating chamber and an upper waveguide extended from an upper end of the side wave guide along an outer face of the ceiling wall to an end portion opposed to the upper end of the side waveguide, wherein the upper waveguide has opposing front and rear waveguide walls extended from the upper end of the side waveguide to the end portion of the upper waveguide, wherein the plurality of electricity feeding ports are formed by at least two or more kinds of electricity feeding ports having different shapes and opening areas, wherein when the plurality of electricity feeding ports are aligned in a front and rear direction of the ceiling wall, the opening area of the electricity feeding port at a position proximate to a center of the ceiling wall is set to be larger than the opening area of the electricity feeding port at a position remote from the center of the ceiling wall, and the opening area of the electricity feeding port at a position proximate to the center of the ceiling wall reaches the end portion of the upper waveguide and a corner of the upper waveguide, and the opening area of the electricity feeding port at a position remote from the center of the ceiling wall reaches the end portion of the upper waveguide and does not reach the rear waveguide wall, wherein a distance between an antenna of the magnetron and a center of the opening area of each of the electricity feeding port at a position proximate to the center of the ceiling wall and the electricity feeding port at a position remote from the center of the ceiling wall is g/2 multiplied by an integer, wherein g is a wavelength of the microwave propagated at an inside of the waveguides, and wherein an inclined face is formed at a connecting portion between the upper waveguide and the side waveguide.

2. The microwave heating apparatus according to claim 1, wherein the antenna of the magnetron is arranged to be directed to a side of the heating chamber and to be opposed to the side wall and the side wall is formed with a bulged portion bulged to an inner side of the chamber for avoiding interference with the antenna.

3. The microwave heating apparatus according to claim 1, wherein the plurality of electricity feeding ports are formed in a rectangular shape slender in a width direction of the heating chamber.

4. The microwave heating apparatus according to claim 1, wherein a heating member in a linear shape for heating by a heater is attached to the ceiling wall of the heating chamber and a center axis of the heating member is constituted to be more proximate to a line equally dividing the ceiling wall into two in a front and rear direction than a center axis line in a width direction of the upper wave guide arranged at the ceiling wall.

5. The microwave heating apparatus according to claim 4, wherein the heating member is arranged to be inclined to the line equally dividing the ceiling wall into two in the front and rear direction.

6. The microwave heating apparatus according to claim 1, wherein the heating member is positioned such that a horizontal centerline of the heating member is located above the opening areas of the plurality of feeding ports.

7. The microwave heating apparatus according to claim 1, wherein the magnetron is disposed adjacent to the side surface at the lateral side of the heating chamber and adjacent an end of the side wave guide that is extended away from the upper wave guide.

8. The microwave heating apparatus according to claim 1, wherein a heating member in a linear shape for heating by a heater is mounted in a recessed portion of the ceiling wall of the heating chamber and the plurality of electricity feeding ports are mounted to the ceiling wall, both the heating member and the plurality of electricity feeding ports being mounted at a position away from a line equally dividing the ceiling wall into two in a front and rear direction.

9. A microwave heating apparatus for radiating a microwave oscillated from a magnetron to a heating chamber via a waveguide, wherein a plurality of electricity feeding ports for radiating the microwave are provided at a ceiling wall of the heating chamber, and the wave guide is formed in an L-like shape including a side waveguide extended upwardly along an outer side face of the heating chamber and an upper waveguide extended from an upper end of the side wave guide ports along an outer face of the ceiling wall to an end portion opposed to the upper end of the side waveguide, wherein the upper waveguide has opposing front and rear waveguide walls extended from the upper end of the side waveguide to the end portion of the upper waveguide, wherein the plurality of electricity feeding ports are formed by at least two or more kinds of electricity feeding ports having different shapes and opening areas, wherein when the plurality of electricity feeding ports are aligned in a front and rear direction of the ceiling wall, the opening area of the electricity feeding port at a position proximate to a center of the ceiling wall is set to be larger than the opening area of the electricity feeding port at a position remote from the center of the ceiling wall, and the opening area of the electricity feeding port at a position proximate to the center of the ceiling wall reaches the end portion of the upper waveguide and a corner of the upper waveguide, and the opening area of the electricity feeding port at a position remote from the center of the ceiling wall reaches the end portion of the upper waveguide and does not reach the rear waveguide wall, wherein a distance between an antenna of the magnetron and a center of the opening area of each of the electricity feeding port at a position proximate to the center of the ceiling wall and the electricity feeding port at a position remote from the center of the ceiling wall is g/2 multiplied by an integer, wherein g is a wavelength of the microwave propagated at an inside of the waveguides, and wherein an inclined face is formed at a connecting portion between the upper waveguide and the side waveguide.

10. The microwave heating apparatus according to claim 9, wherein the magnetron is disposed adjacent to the side surface at the lateral side of the heating chamber and adjacent an end of the side wave guide that is extended away from the upper wave guide.

11. The microwave heating apparatus of claim 9 wherein a width of the waveguide is greater than $\lambda_0/2$ and less than $\lambda_0$ and the height of the waveguide is less than $\lambda_0/2$, wherein $\lambda_0$ is a wavelength of the microwave in a free space.

* * * * *